United States Patent [19]

Fukuda et al.

[11] 4,075,442

[45] Feb. 21, 1978

[54] MINIATURE SLIDE SWITCH ASSEMBLY HAVING FLEXIBLE DETENT ON MOVABLE ACTUATOR OR FIXED HOUSING

[75] Inventors: Hiroshi Fukuda; Tooze Kuzuo, both of Tokyo, Japan

[73] Assignee: Matsu Kyu Kabushiki Kaisha, Tokyo, Japan

[21] Appl. No.: 713,217

[22] Filed: Aug. 9, 1976

[30] Foreign Application Priority Data

Feb. 26, 1976 Japan ..... 51-28898

[51] Int. Cl.[2] ..... H01H 15/02; H01H 9/00

[52] U.S. Cl. ..... 200/16 F; 200/16 R; 200/16 D; 200/291; 200/295; 200/303

[58] Field of Search ..... 200/6 R, 6 B, 6 BA, 200/6 BB, 6 C, 11 DA, 16 R, 16 D, 16 E, 16 F, 291, 292, 294–296, 303, 16 B, 16 C

[56] References Cited

U.S. PATENT DOCUMENTS

| | | | |
|---|---|---|---|
| 3,501,599 | 3/1970 | Horecky | 200/16 D |
| 3,502,825 | 3/1970 | Bailey et al. | 200/16 D |
| 3,525,825 | 8/1970 | Allison | 200/295 X |
| 3,592,983 | 7/1971 | Kroll et al. | 200/295 X |
| 3,900,709 | 8/1975 | Sheesley et al. | 200/6 BB X |
| 3,912,887 | 10/1975 | Gratz et al. | 200/303 X |
| 3,947,391 | 3/1976 | Lutzenberger | 200/16 D |
| 3,978,298 | 8/1976 | Fukuda et al. | 200/6 C X |
| 3,983,341 | 9/1976 | Stamish | 200/295 X |

*Primary Examiner*—James R. Scott

*Attorney, Agent, or Firm*—Haseltine, Lake & Waters

[57] ABSTRACT

A miniature slide switch assembly in which a fixed base member, has a pair of opposite longitudinal side surface, molded out of any suitable insulating material. Each of the side surface is provided with a pair of recesses. At least two adjacent molded fixed contacts are disposed in the longitudinal direction of the base member. A movable casing member slidably rides on the base member in such a manner that it can slide in the direction of the array of the fixed contacts, each of opposite side surfaces of the movable casing member having a resilient detent bar. The resilient detent bar is provided with, at the top end thereof, a finger capable of being alternately snap fitted into the recesses, and an electrically conductive inversed U-shaped strip is accommodated in the cavity of the movable casing member. This strip can slide over the adjacent fixed contacts in accordance with the movement of the movable casing member, whereby, when the conductive strip is in the first position, it bridges two adjacent fixed contacts, and when the conductive strip is in the second position, the bridging of the conductive strips between two adjacent fixed contacts is broken.

4 Claims, 17 Drawing Figures

MINIATURE SLIDE SWITCH ASSEMBLY HAVING FLEXIBLE DETENT ON MOVABLE ACTUATOR OR FIXED HOUSING

BACKGROUND OF THE INVENTION

The present invention relates to a miniature slide switch assembly and, more particulaly, to a miniature slide switch assembly including a movable casing member slidably riding on a base member in which a plurality of fixed contacts are incorporated.

Recent rapid progress in miniaturization of electric circuits urgently necessities the miniaturization of the associated components. Slide switch assemblies, which are broadly used in various kinds of electronic devices, come naturally within such a requirement.

A conventional slide switch assembly consists of an electrically insulating base member, a plurality of fixed contacts assembled with the base member, a plurality of electrically conductive strips fitted over the fixed contacts, a slider which accommodates therein the conductive strips, and a casing member of a metallic material fixed on the base member, the slider being slidably provided on the base member within the casing member. The conventional slide switch assembly further includes a detent mechanism for detenting the slider to the casing member, wherein the detent mechanism comprises, for example, a plurality of biasing springs provided between an outer surface of the slider and an inner wall of the casing member, a plurality of steel balls connected to the biasing springs, and a detent recess which is provided in the inner wall of the casing member and is positioned so that the steel balls may be fitted into the detent recess in the ON-condition of the switching assembly.

The steps of assembling the fixed contacts with the base member includes inserting a plurality of parallel fixed contacts integral with a common strip at the top thereof into a plurality of bores respectively provided in the base member, securing the respective fixed contacts into the base member using a proven caulking method, strengthening the connection of the fixed contacts to the corresponding bores by filling possible clearance space therebetween with any suitable adhesives, and then separating the common strip from all the fixed contacts.

Since the conventional slide switch assembly is thus constructed, it suffers from additional drawbacks. First is that it is difficult to reduce the number of the components, because of the fact that the slider is provided separately from the casing member and because of the fact that the detent mechanism includes a plurality of steel balls and biasing springs. Second is that relatively many steps of fabrication of the switch assembly are also required for the same reason as above. Third is that it is very difficult to automate the fabrication of the switch assembly, and therefore the switch assembly is expensive to fabricate. Fourth is that it is difficult to apply a plating to those portions of the fixed contacts that will be brought into contact with the conductive strip because of the fact that individual fixed contacts are integral with a common strip at the top thereof. Fifth is that it is difficult to keep constant a force necessary for detent the slider to the casing member.

SUMMARY OF THE INVENTION

It is, therefore, an object of the present invention to provide a miniature slide switch assembly in which number of components as well as the fabricating steps thereof can be reduced.

It is another object of the present invention to provide a miniature slide switch assembly the fabrication of which is easy to automate and which is reduced in price.

It is still another object of the present invention to provide a miniature slide switch assembly to which it is easy to apply a plating to those portions of fixed contacts that will be brought into contact with a conductive strip.

It is a further object of the present invention to provide a miniature slide switch assembly which can keep constant a force necessary for detenting a movable casing member to a base member when the movable casing member is respectively positioned in the ON-condition and the OFF-condition of the switch assembly.

According to the present invention, there is provided a miniature slide switch assembly consisting of a base member molded out of any suitable insulating material, a plurality of fixed contacts disposed in an array in the base member, the base member being molded, a movable casing member slidably riding on the base member, and a plurality of electrically conductive strips accommodated within the movable casing member, the conductive strips being slidable over the fixed contacts from one of a first and a second position to the other in accordance with the movement of the movable casing member, whereby when the respective conductive strips are in the first position, each of the conductive strips bridges two adjacent fixed contacts, while when the conductive strips are in the second position, the bridging of the conductive strips between two adjacent fixed contacts is broken.

The feature and advantages of a miniature slide switch assembly according to the present invention will become more apparent from the following description taken in conjunction with the accompanying drawings:

DETAILED DESCRIPTION OF PREFERRED EMBODIMENT

Figure 2A:
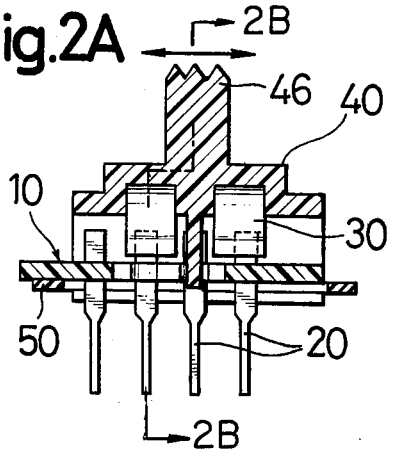
FIG. 2A is a schematic cross sectional front view of the first preferred embodiment of the miniature slide switch assembly according to the present invention.
Figure 2B:
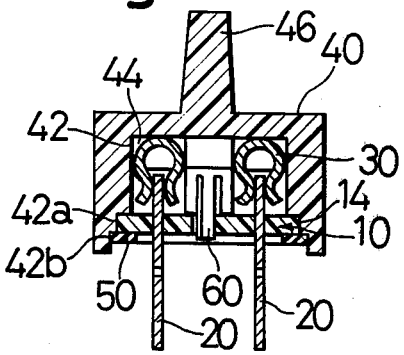
FIG. 2B is a cross sectional view taken along the line 2B–2B of FIG. 2A.
Figure 2C:
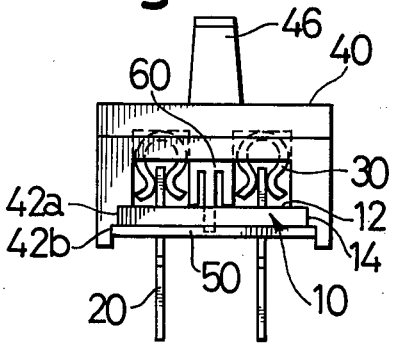
FIG. 2C is a side elevational view of the assembly of FIG. 2A.
Figure 2E:
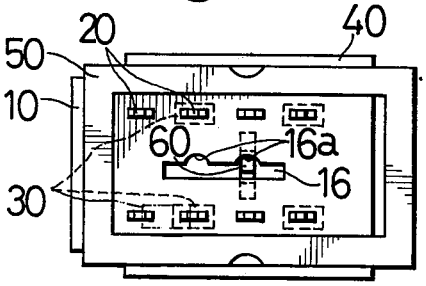
FIG. 2E is a bottom view of the assembly of FIG. 2A.
Figure 2D:
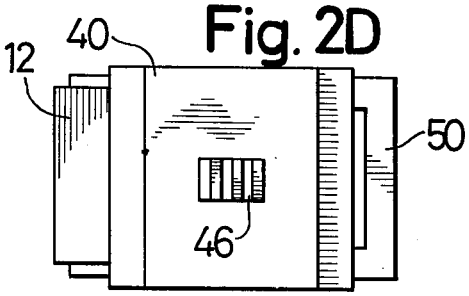
FIG. 2D is a plan view of the assembly of FIG. 2A.

FIG. 2B shows a cross sectional side elevational view of the first embodiment of the slide switch assembly according to the present invention, generally illustrating the interrelation between the respective components.

Those components and the interrelation thereof will be described in detail with reference to FIGS. 1, 2A, 2B, 2C, 2D, 2E, 3, 4 and 5.

Figure 1:
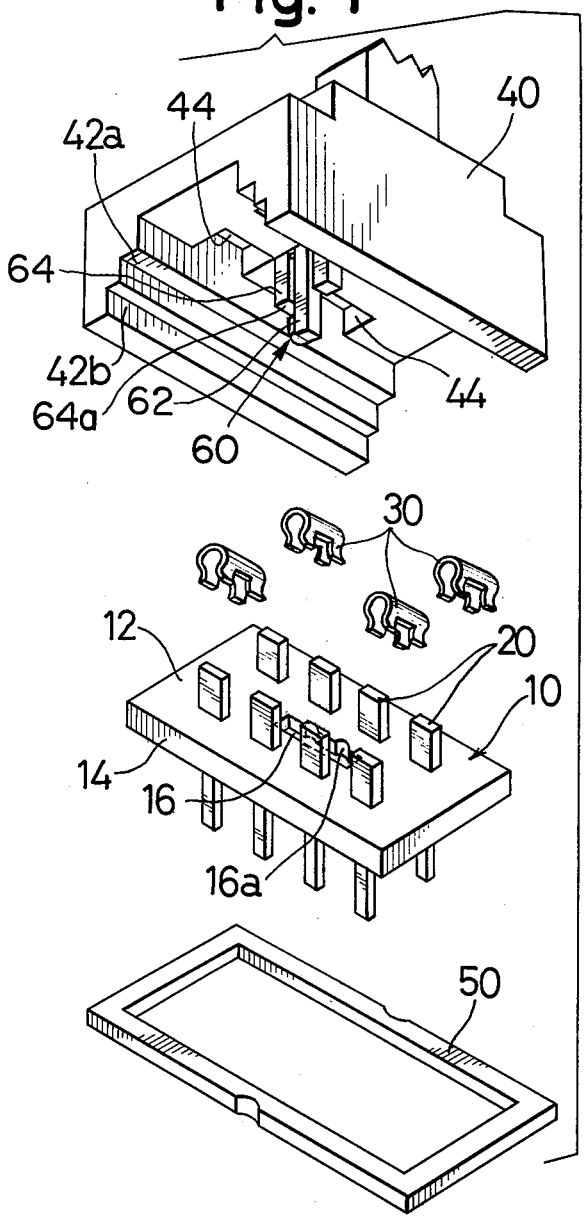
FIG. 1 is a fragmentary, exploded view of the switch assembly according to the first embodiment of the present invention.

As seen from FIG. 1, the slide switch assembly of the present invention is composed of a base member 10, a plurality of fixed contacts 20, a plurality of electrically conductive strips 30, a movable casing member 40, and a support frame member 50 to be described later in more detail.

Figure 4:
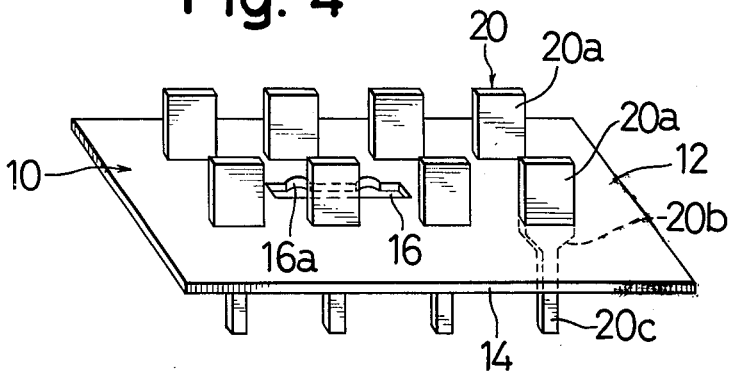
FIG. 4 is a schematic perspective view of a molded base member in which a plurality of fixed contacts are incorporated, as used in the first embodiment of the present invention.

As shown in FIG. 4, the base member 10 having a rectangular shape is molded out of any suitable insulating material, such as thermoplastic resin.

A plurality of fixed brass contacts are perpendicularly incorporated in the surface 12 of the base member. Each fixed contact 20 consists of a contact plate 20*a* having a pair of tapered edges 20*b* at the lower end thereof and elongated leg portions 20*c* integral with the top end of the tapered edges 20*b*. The respective fixed contacts 20 are equispacedly aligned in two rows in the longitudinal direction of the base member 10. The fixed contacts 20 in one row and the corresponding fixed contacts 20 in the other row are oppositely disposed to each other on the base member 10.

The movable casing member 40 of thermoplastic resin slidably rides on the base member 10 so as to move in the direction of the rows of the fixed contacts 20. (See FIGS. 2A, 2B and 2C)

In more detail, the movable casing member 40 is provided with a pair of inner side walls 42, each side wall 42 including at the lower end thereof a first and a second step portion 42*a* and 42*b* which extend in the longitudinal direction of the movable casing member 40.

Each step portion 42*a* is movably and resiliently engaged with a pair of longitudinal side surfaces 14 of the base member 10 respectively. A support frame member 60 for preventing the base member 10 from slipping off the movable casing member 40 is fitted between each step portion 24*b*. The movable casing member 40 further comprises a pair of cavities 44 between the side walls 42 and a three-forked projecting portion 60 which is provided integrally with and within the movable casing member 40 and which projects downward, and a manual knob 46 which is provided integrally with the movable casing member 40.

The plurality of conductive inversed U-shaped metal strips 30, accommodated in the cavities 44 of the movable casing member 40, are provided slidably on the fixed contacts 20 from one of a first position (which, for example shows the ON-condition of the switch assembly), designated reference character I and a second position (which, for example shows the Off-condition of the switch assembly, designated by reference character II to the other in accordance with the movement of the movable casing member. (See FIGS. 2B, 2C and 2E)

Figure 5:
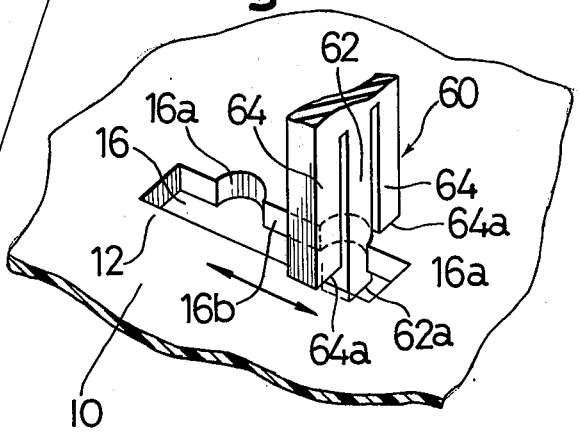
FIG. 5 is a plan view illustrating the interrelation between a recess provided in the base member and a projection, which is snap fitted into the recess, integrally provided in the movable casing member, as used in the first embodiment of the present invention.

As best seen from FIG. 5, a detent mechanism consists of a combination of a bore, designated by reference numeral 16, which is provided in the direction of the array of fixed contacts 20 in the base member 10, and the three-forked projecting portion 60 which is formed integrally within the movable casing member 40 and consists of a central projection 62 which extends downward and is fitted into the bore 16, and a pair of side parallel projections 64 which extend downward and are respectively positioned in the opposite sides of the projection 62. The side projections 64 are shorter in length than the central projection 62 and are disposed on the base member 10 so that the lower ends 64*a* thereof are slidable in contact with the upper surface 12 on the base member 10 while the lower ends 62*a* of the central projection 62 moves in the bore 16 provided in the base member 10. The bore 16 includes a pair of semi-circular recesses 16*a* provided in the side surface positioned in the longitudinal direction of the bore 16, and a flat portion 16*b* between the recesses 16*a*. The central projection 62 is snap fitted into the recesses 16*a* and is resiliently engaged in the recesses 16*a* when the movable casing member 40 moves in the direction of the array of the fixed contacts 20.

Figure 3:
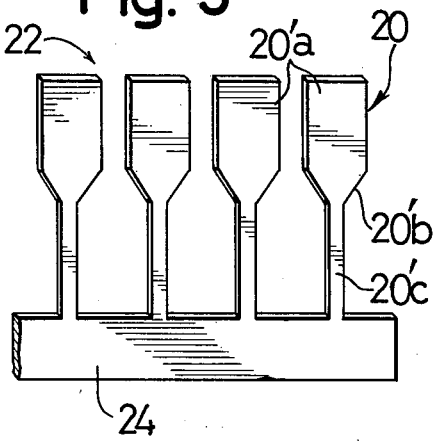
FIG. 3 is a schematic perspective view of a multi fixed contact strip used in the switch assembly at the bottom thereof integral with a common strip according to the present invention.

As best shown in FIG. 3, the desired length of the multi fixed contact strip 22 can be stamped from any suitable metal strip of for example, Cu. That is, the multi fixed contact strip 22 consists of a plurality of equispaced fixed-contact portions 20′ and a common strip 24 integral therewith. Each fixed-contact portion 20′ consists of a contacting plate 20′*a* having a pair of tapered edges 20′*b* at the lower end thereof, and an elongated leg portion 20′*c* integral with the end of the tapered edges 20′*b*. The common strip 24 is cut away from the fixed-contact portion 20′ after the completion of switch assembly, in order to form the individual fixed contacts 20.

In order to bring about an improvement in switching characteristics, as a first step, any length of multi fixed contact strip 22 with the fixed-contact portions 20′ being suspended downward, is horizontally and continuously fed into a first plating pool (not shown) in such a manner that only the fixed-contact portion 20′ is passed and plated with any suitable relatively cheap plating liquid. As a second step, the multi fixed contact strip 22 thus plated at the first step is further fed horizontally so that the ends of the suspended fixed-contact portions 20′ are passed through and plated with Au plating liquid in a second plating pool (not shown).

The base member 10, as shown in FIG. 4, is made by casting any suitable thermoplastic resin material into a predetermined mold in which a plurality of fixed contacts 20, plated as mentioned above, are previously disposed.

In order to fabricate the switch assembly, the following steps are further carried out which include fitting the conductive strips 30 over the fixed contacts 20 provided integrally in the base member 10, fitting the movable casing member 40 on the base member 10 so that the conductive strips 30 are accommodated within the cavities 44 of the movable casing member 40, and fixing a support frame member 50 to the bottom of the movable casing member 40 using a proven melting method.

In operation, the conductive strips 30 accommodated within the movable casing member 40 slide over the fixed contacts 20 in the direction of the array of the fixed contacts from one of the first position I and the second position II to the other in accordance with the movement of the movable casing member 40. Thus, when the conductive strips 30 come to the first position I, the conductive strips 30 will bridge the fixed contacts 20, and when the conductive strips 30 come to the second position II, the bridging of the fixed contacts 20 will be broken.

Simultaneously with the above switching action, the central portion 62 of the three forked porjection 60, formed integrally with the movable casing member 40, slides in contact with the recesses **16*a* and flat portion 16*b* and then is snap fitted to any one of recesses 16*a* in the base member 10, whereby the movable casing member 40 is securely detented to the base member 10** in the first or second position which corresponds to the ON-condition or the OFF-condition of the switch assembly respectively.

As will be obvious from the foregoing description, the first embodiment of the miniature slide switch assembly according to the present invention can provide the following advantages:

a. Since the fixed contacts 20 are formed integrally with the base member 10, the number of fabrication steps as well as the production cost can be reduced.

b. The movable casing member 40 according to the present invention has functions equivalent to those of the casing member and the slider in the prior art described above. For this, the number of the parts of the switch assembly can be reduced and therefore, the production cost will be reduced.

c. Since the multi fixed contact strip 22, with its contact portions 20' suspended downward, is horizontally fed into a plating pool, it is easy to partially plate only those portions of the multi fixed contact strip 22 that it is desired to plate. As a result of this, it will be possible to automate the plating work of the fixed contacts 20 and the plating costs will thereby be reduced. Therefore, the portions in contact with the conductive strip 30 thus preferably plated are protected against corrosion and therefore good switching characteristics can be expected.

d. Since the detent mechanism consists of a plurality of recesses **16*a* provided in the base member 10 and projecting portion 60 which is integral with and within the movable casing member 40 and which is snap fitted to the recesses 16*a*, the movable casing member 40 is securely detented to the base member 10 in the first or second position which corresponds to the ON-condition or the OFF-condition of the switching assembly respectively. Moreover, since the projecting portion 60 is resiliently engaged with the recesses 16*a*, it is easy to keep constant a force necessary for detenting the movable casing member 40 to the base member 10**. Furthermore the detent mechanism is simplified in construction as compared with the conventional one which includes a plurality of biasing springs and steel balls.

e. Aforementioned above the number of parts of the switch assembly, according to the present invention, is reduced, that is to say, to only four: the base member 10 incorporated with the fixed contacts 20, the conductive strip 30, the movable casing member 40 and the support frame member 50.

Moreover, it is to be noted that it is not always necessary to use the support frame member 50 because of the fact that the resilient engagement between the step portions **42*b* of the movable casing member 40 and the side surfaces 14 of the base member 10 prevents the base member 10 from slipping off the movable casing member 40**. In such a case, the number of the parts of the switch assembly according to the present invention can be further reduced to only three.

Next, a second embodiment of the miniature slide switch assembly according to the present invention will be described. The second embodiment is generally similar to the first embodiment as stated above.

The main difference is that the detent mechanism of the second embodiment includes a pair of recesses provided in the side surface of the base member, and a resilient detent bar, which is integral with a longitudinal side wall of the movable casing member, having at the top end thereof a finger capable of being snap fitted into the recesses in the respective positions corresponding to the ON-condition and the OFF-condition of the switch assembly.

FIGS. 6 through 9 illustrate the preferred second embodiment of the switch assembly according to the present invention. In these drawings, the same numeral as used in FIGS. 1 through 5 indicate the same or similar elements of the miniature slide switch assembly and therefore, a detailed description on the same or similar elements is omitted.

Figure 6:
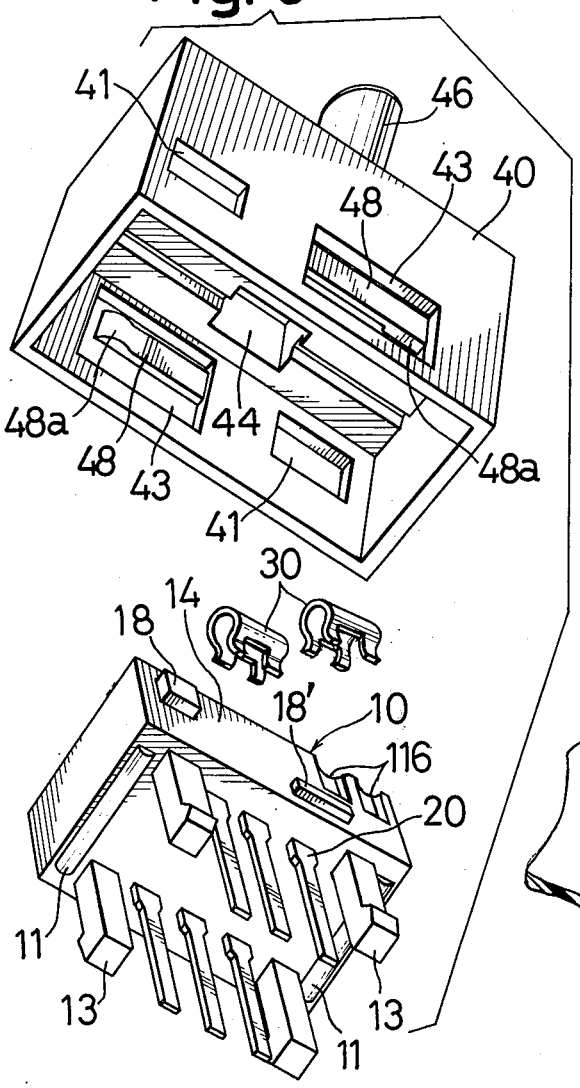
FIG. 6 is a fragmentary, exploded view of the switch assembly according to the second embodiment of the present invention.

As seen from FIG. 6, the slide switch assembly of the second embodiment according to the present invention is assembled from base member 10, a plurality of fixed contacts 20, a plurality of electrically conductive strips 30, and movable casing member 40.

Figure 7:
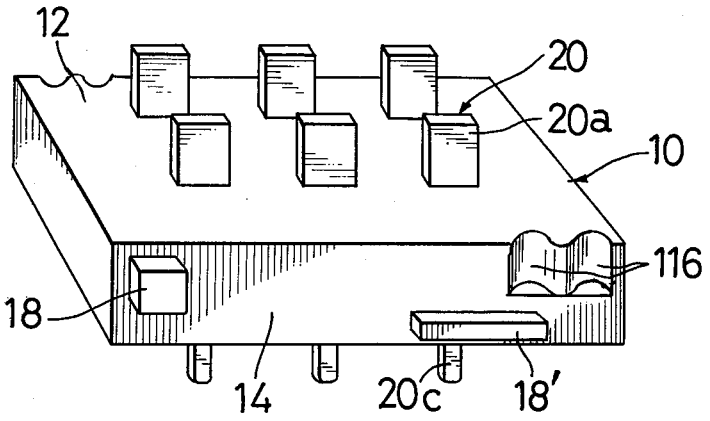
FIG. 7 is a schematic perspective view of the molded base member in which a plurality of fixed contacts are incorporated, as used in the second embodiment of the present invention.
Figure 9:
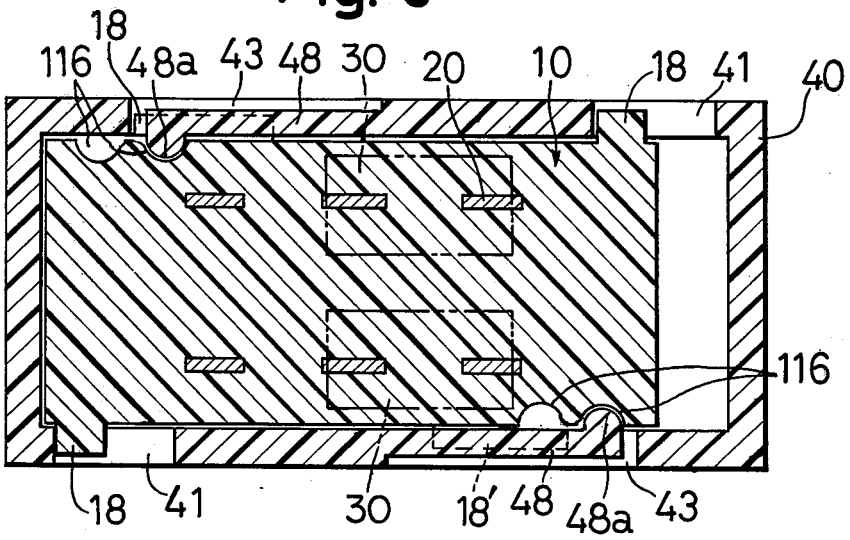
FIG. 9 is a cross sectional view taken along the line 9—9 of FIG. 8A.

As shown in FIG. 7 base member 10 is larger in thickness than that used in the first embodiment and is provided with a pair of recesses 116 in opposite longitudinal side surfaces thereof, a plurality of main stoppers 18 and supplementary ones 18' projecting from the opposite longitudinal side surfaces 14 thereof.

Figure 8A:
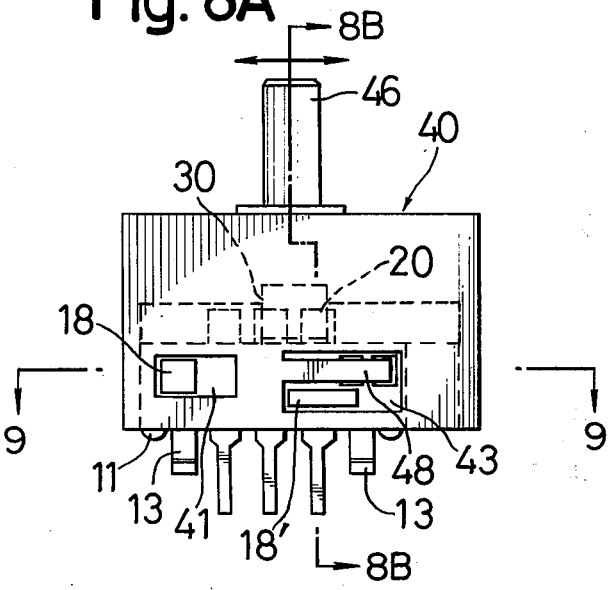
FIG. 8A is a front view of the second preferred embodiment of the miniature slide switch assembly according to the present invention.
Figure 8B:
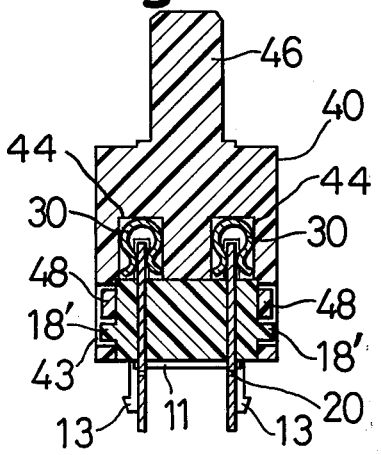
FIG. 8B is a cross sectional view taken along the line 8B—8B of FIG. 8A.
Figure 8C:
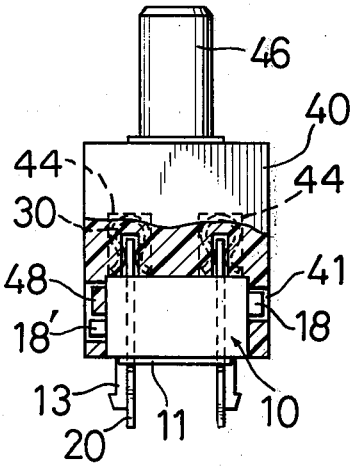
FIG. 8C is a side elevational view of the second embodiment the components of which are shown partly broken away.
Figure 8D:
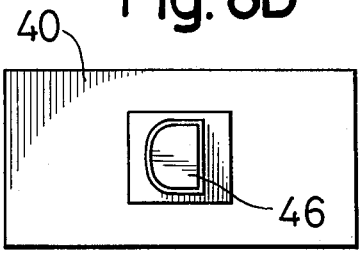
FIG. 8D is a top view of the assembly of FIG. 8A.
Figure 8E:
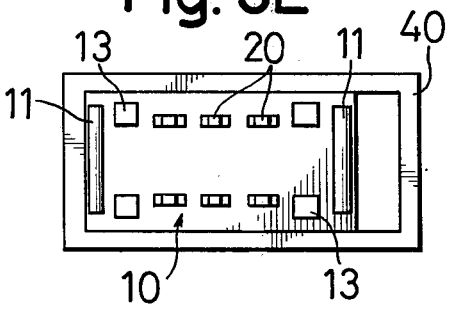
FIG. 8E is a bottom view of the assembly of FIG. 8A.

As shown in FIGS. 8A through 8E, movable casing member 40 is provided with a pair of resilient detent bars 48, which are integral with an opposite longitudinal side wall **40*a* thereof, each of resilient detent bar 48 having at the top end thereof a finger 48*a* capable of being snap fitted into the recesses 116 in the respective portions corresponding to the ON-condition and the OFF-condition of the switch assembly. In more detail, movable casing member 40 is provided with a first and second slot 41 and 43 in an opposite longitudinal side wall thereof as shown in FIG. 8A**.

The stoppers 18 and 18' are respectively provided in slots 41 and 43 to prevent base member 10 from slipping off movable casing member 40 and for limiting the movement of the movable casing member in the direction of the rows of fixed contacts. In addition, a resilient detent bar 48 integral with movable casing member 40 is positioned in the slot 43 and is capable of being snap fitted into any one of the recesses 116.

A projection designated by reference number 11, which gives a clearance space between the base member and a printed board (not shown) is provided at the bottom of the base member 10. A plurality of legs, designated by reference number 13, are provided at the bottom of the base member and serve to fix the base member to the printed board.

As will be obvious from the foregoing description, it will now be appreciated that in addition to the advantages described with respect to the first embodiment, the second embodiment of the miniature slide switch assembly according to the present invention has the following advantages;

The detent mechanism employed in the second embodiment of the present invention consists of a pair of recesses 116 at the each side surface of the base member and a pair of resilient detent bars 48 provided integrally with the movable casing member 40, each of the resilient detent bar having at the top end thereof a finger 48*a* capable of being snap fitted into the recesses 116 in the corresponding to the ON-condition and the OFF-condition of the switch assembly, respectively. With the above detent mechanism various kinds of advantages will be expected as follows;

First is that it is easy to reduce the size of switch assembly, since detent action is performed in such a manner that the resilient detent bar 48 provided at the side wall of the movable casing engages a pair of recesses 116 provided at the side surface of the base member 10.

Second is that it is easy to make equal both detent forces occurring in the opposite sliding directions of the movable casing member, since both a pair of detent bars 48 and two pairs of recesses 116 are symmetrically disposed. For this reason, the movable casing member 40 is further detented to the base member 10 in the first or second position of the switching assembly and high reliability of switching action will be greatly appreciated.

Third is that it is not necessary to enlarge the width of the base member 10, provided that fixed contacts row is in parallel with each other in the longitudinal direction of the base member 10 (Dual-in-package), since both a pair of detent bars 48 and a plurality of recesses 116 are provided at the side surface of the switch assembly.

Since the switching assembly is provided with a plurality of slots 41, 43 and stoppers 18, 18' for preventing the base member 10 from slipping off the movable casing member and for limiting the movement of the movable casing member in the direction of the rows of fixed contacts, the switching assembly can be satisfactorily used even in an environment in which vibration may be occur.

What is claimed is:

1. A miniature slide switch assembly comprising:

a. a fixed base member, having a pair of opposite longitudinal side surfaces, molded out of any suitable insulating material, each of said side surface having a pair of recesses, b. at least two adjacent molded fixed contacts disposed in an array in the longitudinal direction of said base member and molded integrally with said base member, each of said fixed contacts comprising a contact plate having a pair of tapered edges at the lower end thereof and elongated leg portions integral with the top end of said tapered edges, said contact plate being disposed above said base member, said leg portions being disposed extending downwards below said base member, c. a movable casing member having opposite longitudinal walls and slidably riding on said base member so that it can slide in the direction of the array of said fixed contacts, a cavity at the upper end of said movable casing member in the upwardly extending direction of said fixed contact, a pair of resilient detent bars integral with said side wall of said movable casing member, each of said resilient detent bars having at the top end thereof a finger capable of being snap fitted into said recesses corresponding to the ON-condition and the OFF-condition of the switch assembly, respectively, d. an electrically conductive strip being inversed U-shaped and being accommodated in said cavity of said movable casing member, said conductive strip being slidable over said fixed contacts from one of a first and a second position to the other in accordance with the movement of said movable casing member, whereby, when said conductive strip is in the first position, it bridges said adjacent fixed contacts, while when said conductive strip is in the second position, the bridging of said strip between said adjacent fixed contacts is broken.

2. A miniature slide switch assembly as defined in claim 1, further comprising a first slot provided in each of said longitudinal side walls of said movable casing member, and a first stopper projecting from each of said longitudinal side surfaces of said base member and located in said first slot for limiting the longitudinal movement of said movable casing member.

3. A miniature slide switch assembly as defined in claim 2, further comprising a second slot in each of said longitudinal side walls of said movable casing member so that said resilient detent bar is positioned within said second slot, and a second stopper projecting from each of said longitudinal side surfaces of said base member and being in said second slot for limiting the longitudinal movement of said movable casing member.

4. A miniature slide switch assembly as defined in claim 3, wherein said fixed contact is fabricated from a contact strip including a plurality of equispaced fixed-contact portions and a common strip integral therewith, each fixed-contact portion comprising a contact plate having a pair of tapered edges at the lower end thereof, and an elongated leg portion integral with the end of said tapered edges.

* * * * *